United States Patent [19]

Kobayashi

[11] 4,271,096

[45] Jun. 2, 1981

[54] CARBURETOR

[75] Inventor: Hiroto Kobayashi, Kamakura, Japan

[73] Assignee: Walbro Far East, Inc., Kawasaki, Japan

[21] Appl. No.: 90,424

[22] Filed: Nov. 1, 1979

[30] Foreign Application Priority Data

Nov. 20, 1978 [JP] Japan ..... 53-142176

[51] Int. Cl.[3] ..... F02M 9/08

[52] U.S. Cl. ..... 261/44 G; 261/62; 261/DIG. 55

[58] Field of Search .... 261/44 G, DIG. 21, DIG. 55, 261/62

[56] References Cited

U.S. PATENT DOCUMENTS

| | | | |
|---|---|---|---|
| 1,204,247 | 11/1916 | Claudel | 261/44 G |
| 1,259,105 | 3/1918 | Joret | 261/DIG. 21 |
| 1,737,496 | 11/1929 | Feroldi | 261/44 G |
| 2,578,857 | 12/1951 | Sumpter | 261/44 G |
| 4,044,080 | 8/1977 | Matsumoto et al. | 261/DIG. 55 |

FOREIGN PATENT DOCUMENTS

| | | | |
|---|---|---|---|
| 707019 | 4/1954 | United Kingdom | 261/44 G |

*Primary Examiner*—Tim R. Miles

*Attorney, Agent, or Firm*—Barnes, Kisselle, Raisch & Choate

[57] ABSTRACT

An all-position carburetor having an air fuel mixing passage with a rotary throttle valve rotatably disposed in the carburetor body across the mixing passage. The throttle valve has an opening therethrough to provide a venturi passage in conjunction with the mixing passage. A by-pass groove is formed in the outer surface of the rotary valve on the bearing surface of the body to allow fuel which might otherwise accumulate in a pocket, in certain positions of the carburetor, to flow into the main air fuel mixture, thus avoiding overrich conditions when the carburetor is turned from one position to another.

2 Claims, 5 Drawing Figures

CARBURETOR

FIELD OF INVENTION:

Diaphragm carburetor with rotary throttle valve.

BACKGROUND OF THE INVENTION:

This invention relates to a carburetor for an internal combustion engine, and more particularly to a carburetor equipped with a rotary throttle valve and adapted for being incorporated in a two-cycle engine used as a drive source for a chain saw, reaper, bush cutter or the like.

A carburetor equipped with a rotary throttle valve for an internal combustion engine has heretofore been proposed. In such a carburetor, the rotary throttle valve is turned to change a relative position of a venturi hole running across the throttle valve to an air hole provided in the carburetor body, to thereby vary an effective diameter of the air hole, whereby an amount of fuel being injected from a fuel nozzle disposed in the venturi hole is controlled. Such a carburetor successfully controls the usual running modes of an engine properly and highly responsively by turning the throttle valve.

When the throttle valve assumes an idling opening position, a flow rate of intake air passing through the venturi hole becomes low, thus decelerating atomization of a fuel, such that in the idling of the engine at a specific posture of the carburetor, smooth supply of the fuel from the nozzle to the internal combustion engine by the streams of air is incomplete, resulting in part of the fuel being accumulated in the venturi hole. Such a carburetor has an advantage of controlling the usual running modes excluding the idling, of an engine properly and highly responsively, irrespective of the posture of the carburetor, and on the other hand, is disadvantageously accompanied by the lowered performance at the idling of the engine at a specific posture of the carburetor. Particularly in the case where the carburetor valve is turned with the up side down from the aforesaid specific posture, the fuel accumulated in the venturi hole is abruptly drawn under suction into the internal combustion engine causing an overrich condition leading of the stopping of the engine.

Because of the above-described drawback, the prior art carburetor with a rotary throttle valve could not find applications to an internal combustion engine of a chain saw or defrosting instruments which must provide a good performance even at any posture of the carburetor, resulting in limitation in application.

It is an object of the present invention to provide a rotary-throttle-valve-type carburetor which is capable of controlling all of the running modes including the idling, of an internal combustion engine properly, even at any posture of the carburetor, with the freedom from the drawbacks of the prior art carburetor of the type.

One of the features of the present invention consists in the provision of a by-pass for guiding to the fuelair inlet of an internal combustion engine any fuel tending to accumulate in a venturi hole in a rotary throttle valve in certain positions of the engine. This prevents the fuel from being accumulated in the venturi hole and avoid a pocket of fuel which might be dumped into an engine upon a shift of posture of the engine to cause an overrich condition leading to stopping the engine.

This and other features of the present invention will be apparent from the description of the specification in conjunction with the accompanying drawings which indicate preferred embodiments of the invention.

Figure 1:
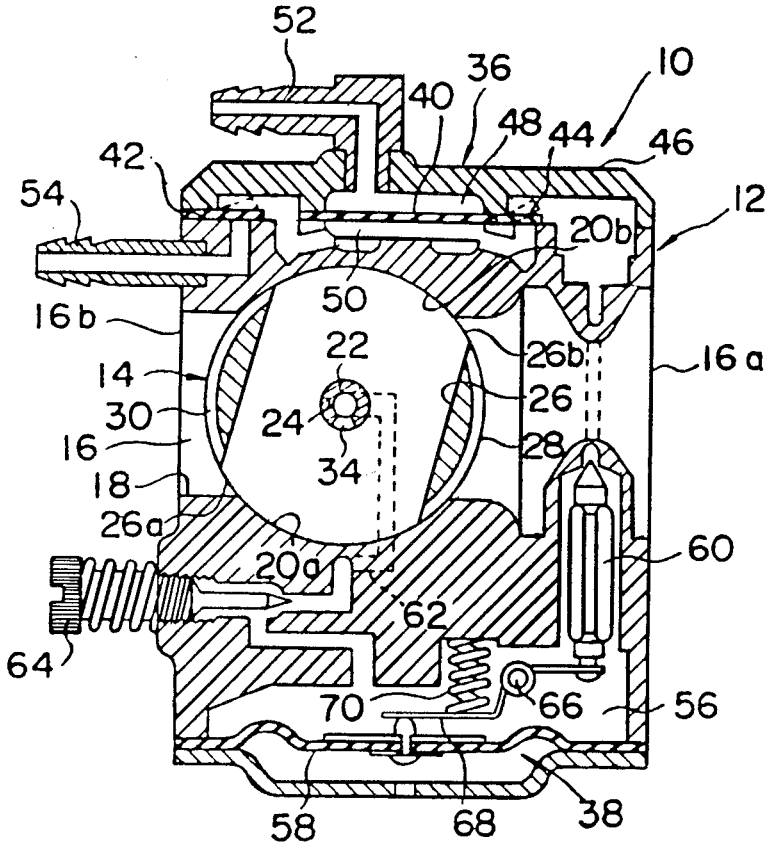
FIG. 1 is a longitudinal cross-sectional view of a carburetor according to the present invention.

DETAILED DESCRIPTION OF THE INVENTION:

Referring to FIG. 1, a carburetor according to the present invention is generally shown at a reference numeral 10. The carburetor 10 includes a carburetor body 12, and a generally columnar rotary throttle valve 14 incorporated in the carburetor body.

The carburetor body 12 has an air hole 16 running therethrough. The air hole 16 is connected at one end 16*a* to an air cleaner (not shown), thus being communicated by way of the air cleaner with atmosphere, and connected at the other end 16*b* thereof to an intake pipe (not shown) of an engine, thus being communicated by way of the intake pipe with an intake port of the engine. A pair of arcuate recesses 20 (20*a*, 20*b*) are provided in the peripheral wall 18 of the air passage 16 in an opposed relation to each other in conformity with the outer contour of the throttle valve, so as to receive therein the throttle valve 14 rotatably across the air hole 16.

Figure 2:
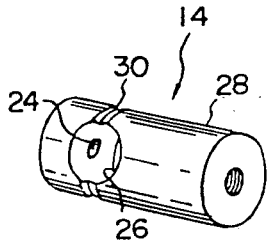
FIG. 2 is a perspective view of a rotary throttle valve shown in FIG. 1.
Figure 3:
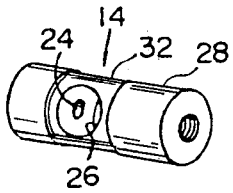
FIG. 3 is a view similar to FIG. 2 showing another embodiment of the present invention.

The throttle valve 14 rotatably fitted in the recesses 20 has a longitudinal axial hole 24 for receiving therein a fuel nozzle, as seen in FIG. 2, and a venturi hole 26 running across the hole 24, namely, across the throttle valve 14. The venturi hole 26 has an inner diameter uniform and substantially equal to the inner diameter of the air hole 16 in the vicinity of the recesses 20 thereof. A V-shaped groove 30 runs in the outer peripheral surface 28 of the throttle valve 14 circumferentially thereof between the opposite open ends of the venturi hole 26. Instead of the V-shaped groove 30, a shallow groove 32 as shown in FIG. 3 may be provided, having a width larger than a diameter of the venturi hole 26. The width of such shallow groove 32 may be smaller than the diameter of the venturi hole 26.

The throttle valve 14, as described above, is rotatably housed in the recess portion, with the outer peripheral surface 28 of the former being in contact with the inner walls of the recesses 20. A fuel nozzle 22 is disposed in the hole 24 in the throttle valve, with a jetting port 34 directed down (in FIG. 1) within the venturi hole 26, and fixed to the carburetor body 12, as shown in FIG. 1. The jetting port 34 of the nozzle may be open to any desired direction.

In FIG. 1, the throttle valve 14 is shown as taking an idling opening position. When the valve is in the idling opening position, one open end 26*a* of the venturi hole 26 is open by only a small degree to the air hole 16 on the internal combustion engine side on the side of one recess portion 20*a*, and the other open end 26*b* of the venturi hole is slightly open to the air hole 16 on the atmosphere side on the other recess portion 20b, in order to throttle an effective diameter of the air hole 16. The throttle valve 14, likewise the prior art throttle valve, is adapted to be turned clockwise, as viewed in FIG. 1, by means of a throttle lever (not shown) disposed externally of the carburetor body, so as to bring the venturi hole 26 into register with the air hole 16. The effective diameter of the air hole 16 is increased by moving the lever. When the lever is released, the throttle valve 14 resumes the idling opening position. The V-shaped groove 30 running in the outer peripheral surface 28 of the throttle valve 14 provides a small clearance between the recess portions 20 and the outer peripheral surface 28 of the valve 14, irrespective of the state of the throttle lever. The cross-sectional area of the clearance is extremely small, in comparison with the cross-sectional area of the open portion of one open end 26a of the venturi hole 26, and hence such a clearance can be negligible even at the idling of the engine.

The carburetor body 12 further includes a pump mechanism 36 operated so as to draw under suction a fuel from a fuel tank (not shown), and a constant-pressure mechanism 38 for supplying the fuel drawn under suction by the pump mechanism to the nozzle 22 under a constant pressure.

The pump mechanism 36 is a known diaphragm pump having a diaphragm 40 and a pair of check valves 42 and 44. The diaphragm 40 is held at the outer circumferential portion thereof between the carburetor body 12 and a cover 46 attached to the carburetor body, thereby defining a diaphragm chamber 48 on the cover side and a pump chamber 50 on the carburetor body side 12. In order to operate the diaphragm 40, a working pressure having pulsation of the internal combustion engine, for example, a crank chamber pressure in a two-cycle engine, is introduced by way of a passage 52 into the diaphragm chamber 48. By the operation of the diaphragm 40, a fuel is drawn under suction from passage 54 connected to the fuel tank by way of one check valve 42 into the pump chamber 50, and the fuel in turn is fed by way of the other check valve 44 to the constant-pressure mechanism 38.

The constant pressure mechanism 38, as is well known, includes a diaphragm 58 which defines a diaphragm chamber 56 into which a fuel is to be fed from the pump mechanism 36, and a valve member 60 for interrupting communication between the pump mechanism 36 and the diaphragm chamber 56 in association with operation of the diaphragm. The diaphragm chamber 56 is communicated by way of that fuel passage 62 with the nozzle 22, in which fuel passage is provided a known adjusting screw 64 for adjustment of a fuel. Disposed between the valve member 60 and the diaphragm 58 is a lever 68 having a pin 66. When strong vacuum for suction is developed by way of the fuel passage 62 in the diaphgram chamber 56, the diaphragm 58 actuates the valve member 60 by means of the lever 68, so as to introduce the fuel from the pump mechanism into the diaphragm chamber 56. As a result of the fuel introduced into the diaphragm chamber 56, the strong vacuum in the diaphragm chamber 56 becomes null, and the valve member 60 in turn is moved by the biasing force of a compression spring 70 engaging the lever 68 to a position to impede introduction of the fuel into the diaphragm chamber 56. This movement of the valve member 60 causes weak vacuum of a constant level to act in the diaphragm chamber 56 in the known fashion, so that a given amount of fuel is usually preserved in the diaphragm chamber 56 serving as a constant pressure chamber. The fuel in the diaphragm chamber is guided usually in an optimum condition by way of the fuel passage 62 to the nozzle 22, independently of the posture of the carburetor 10.

In the case where the throttle valve 14 is retained in the idling opening position at that posture of the carburetor 10 in which one recess 20a in the carburetor body is positioned above and the other recess 20b thereof positioned below as seen in FIG. 1, then the streams of intake air flowing from a portion open to the atmosphere side, of the other open end 26b of the venturi hole 26 to a portion open to the intake port side, of the one open end 26a thereof are directed downward, likewise in the prior art carburetor. Thus, a proper amount of fuel injected from the jetting port 34 of the nozzle 22 into the venturi hole 26 is carried by the streams of intake air and supplied by way of one open end 26a to the internal combustion engine. Thus, at the above-described posture of the carburetor 10, the fuel from the nozzle is by no means accumulated in one recess 20a positioned in the lower portion of the venturi hole 26 likewise in the prior art carburetor, thus maintaining the idling of the engine in the optimum state.

Figure 4:
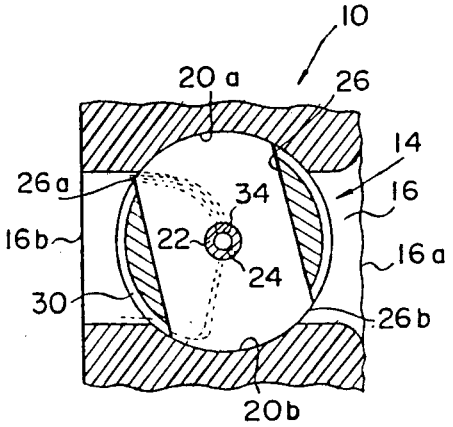
FIG. 4 is a fragmentary longitudinal cross-sectional view of the carburetor, showing how to control the idling of the engine when the carburetor of FIG. 1 assumes an upset position.

When the carburetor 10 is upset during the idling of the engine, and the other recess 20b is positioned below as shown in FIG. 4, then the streams of intake air are directed upward, so that the major part of the fuel from the jetting port 34 of the nozzle 22 will be suppled by way of one open end 26a to the engine, as in the prior art carburetor, while the remaining part of fuel will drop to the other recess 20b positioned below, rather than being carried by means of the streams of intake air to the one open end 26a. In this connection, it is noted that part of the groove 30 is open at one end to the other recess 20b and serves at the other end as a by-pass open to the intake port side. By such arrangement, part of the fuel dropped to the other recess 20b, rather than staying in the other recess 20b in the venturi hole 26, is carried by means of the streams of air passing through the by-pass, by way of the other open end 26b in the venturi hole 26, to the intake port successively. If the engine is continuously run in the idling mode for a long period of time at the posture of the carburetor as shown in FIG. 4, no fuel accumulates in the venturi hole 26, unlike the prior art carburetor, thus allowing the engine to run in the optimum idling mode, without incurring accumulation of the fuel in the venturi hole, which would lead to the untimely stopping of the engine by an overrich condition when the carburetor was suddenly turned to dump the collected fuel into the engine.

In this embodiment, the groove which defines the by-pass runs over the whole circumference of the throttle valve. As is apparent from the foregoing, such a groove need not be provided throughout the circumference of the valve, but may have a length long enough to guide to the intake port side of the engine part of the fuel dropping to one recess 20a.

Figure 5:
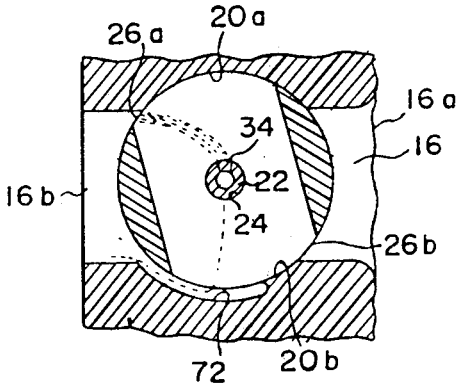
FIG. 5 is a view similar to FIG. 4, showing another embodiment of the present invention.

Instead of the groove serving as the by-pass being provided in the throttle valve, a groove 72 is provided in the inner wall of one recess 20a, as seen in FIG. 5, having a function of the by-pass the same as described above. As an alternative, a passage may be provided in the carburetor body, with one end thereof open from the inner wall of one recess 20a, and with the other end open to the air passage 16, with the same result as described above.

According to the present invention, irrespective of the posture of the carburetor, the idling of the engine is properly controlled. The carburetor of the present invention finds applications for various engines including an engine used as a drive source for a chain saw, reaper, bush cutter or hedge trimmer.

I claim:

1. A carburetor comprising a carburetor body having an air and fuel passage open at one end to an atmosphere intake port and at the other end to an intake port of an internal combustion engine, (a) a pair of arcuate recesses formed in the peripheral wall of said air and fuel passage in the carburetor body in opposed relation to each other, (b) a barrel type rotary throttle valve rotatably disposed within said carburetor body supported for rotation in said opposed arcuate recesses and having a cylindrical venturi hole transverse to the axis of rotation of said valve, said venturi hole being open to the atmosphere intake port and to the engine intake port when the throttle is in open position and being essentially closed to said ports in an idle position, (c) a fuel nozzle disposed in said venturi hole on the axis of said valve to discharge liquid fuel into the venturi hole of said barrel valve, and (d) a shallow surface groove passage extending circumferentially around the entire circumference of the barrel valve in the area of said atmospheric and engine ports wherein air and fuel may pass through said carburetor to the engine intake port regardless of the position of said barrel valve.

2. A combination as defined in claim 1 in which said shallow groove is wider than the axial dimension of the venturi hole in said barrel valve.

* * * * *